US005464155A

United States Patent [19]

Schutter

[11] Patent Number: 5,464,155

[45] Date of Patent: Nov. 7, 1995

[54] SAFETY AIR GUN

[76] Inventor: Raymond A. Schutter, 3950 Harbor Point Dr., Muskegon, Mich. 49441

[21] Appl. No.: 181,593

[22] Filed: Jan. 13, 1994

[51] Int. Cl.[6] ..... B05B 1/28

[52] U.S. Cl. ..... 239/124; 239/428.5; 239/525; 239/531; 239/DIG. 22

[58] Field of Search ..... 239/124, 291, 239/407, 428.5, 525, 530, 531, DIG. 21, DIG. 22, 463, 126

[56] References Cited

U.S. PATENT DOCUMENTS

| | | | |
|---|---|---|---|
| 1,656,160 | 1/1928 | Badaracco | 239/463 X |
| 2,742,332 | 4/1956 | Goettl | 239/463 |
| 3,129,892 | 4/1964 | Tillman | 239/DIG. 22 X |
| 3,647,142 | 3/1972 | Drude et al. | 239/DIG. 22 X |
| 3,743,186 | 7/1973 | Mocarski | 239/DIG. 22 X |
| 3,790,085 | 2/1974 | Ayers | 239/DIG. 22 X |
| 3,796,376 | 3/1974 | Farnsteiner | 239/353 |
| 3,814,329 | 6/1974 | Clark | 239/DIG. 22 X |
| 3,884,419 | 5/1975 | Geoffray | 239/DIG. 22 X |
| 4,010,902 | 3/1977 | Speyer | 239/428.5 |
| 4,026,474 | 5/1977 | Knauer et al. | 239/DIG. 22 X |
| 4,050,632 | 9/1977 | Wyse | 239/DIG. 22 X |
| 4,124,164 | 11/1978 | Bachman | 239/DIG. 22 X |
| 4,243,178 | 1/1981 | Self | 239/DIG. 22 X |
| 4,431,135 | 2/1984 | Kaye | 239/DIG. 21 X |

*Primary Examiner*—Andres Kashnikow
*Assistant Examiner*—Lesley D. Morris
*Attorney, Agent, or Firm*—Waters & Morse

[57] ABSTRACT

A safety air gun that discourages tampering with safety vent holes comprises an internal air channel for delivering pressurized air to a work area. The internal air channel has an expansion chamber of increased cross-sectional area, with an outlet nozzle being positioned at one end of the chamber and an inlet tube extending into the chamber from an opposite end of the chamber. The inlet tube and outer nozzle have ends that are closely spaced across a gap. The expansion chamber also has side vent holes that both relieve dead end pressure and admit ambient air into the pressurized air stream. The gap spacing and outlet contour are such that the air force from the outlet is lower when the vent holes are blocked than when the two vent holes are open.

21 Claims, 2 Drawing Sheets

FIG. 1
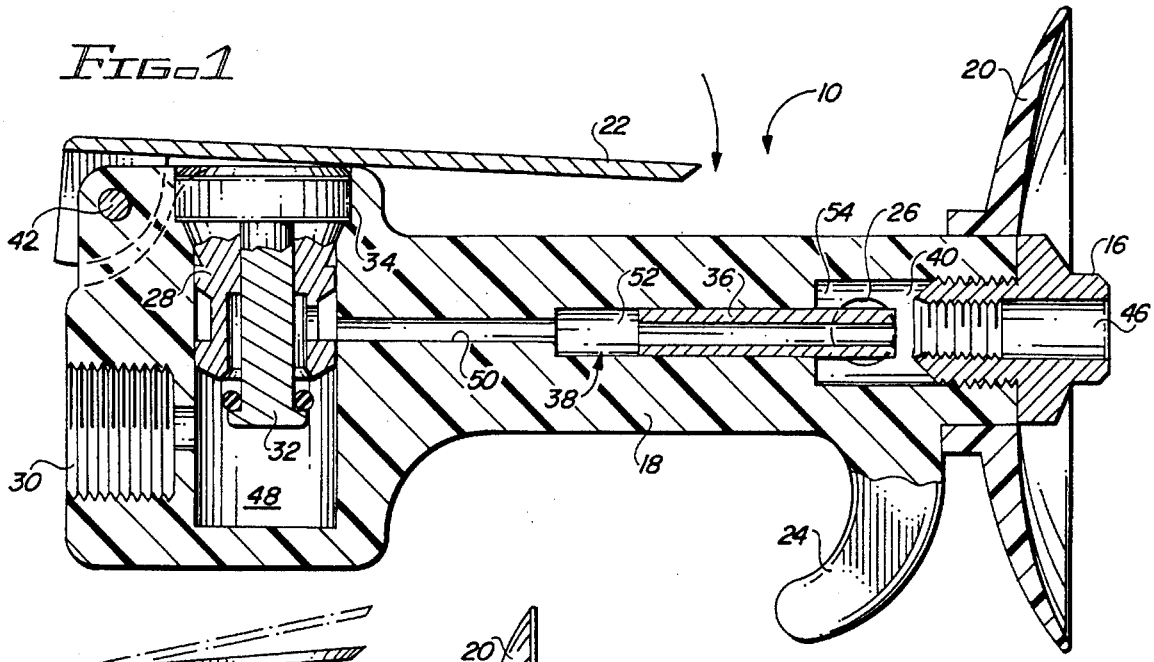
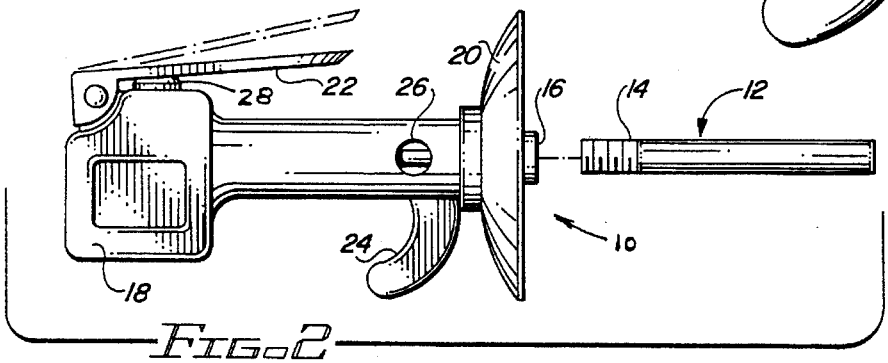
FIG. 2
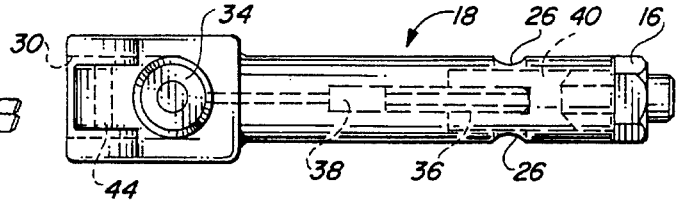
FIG. 3
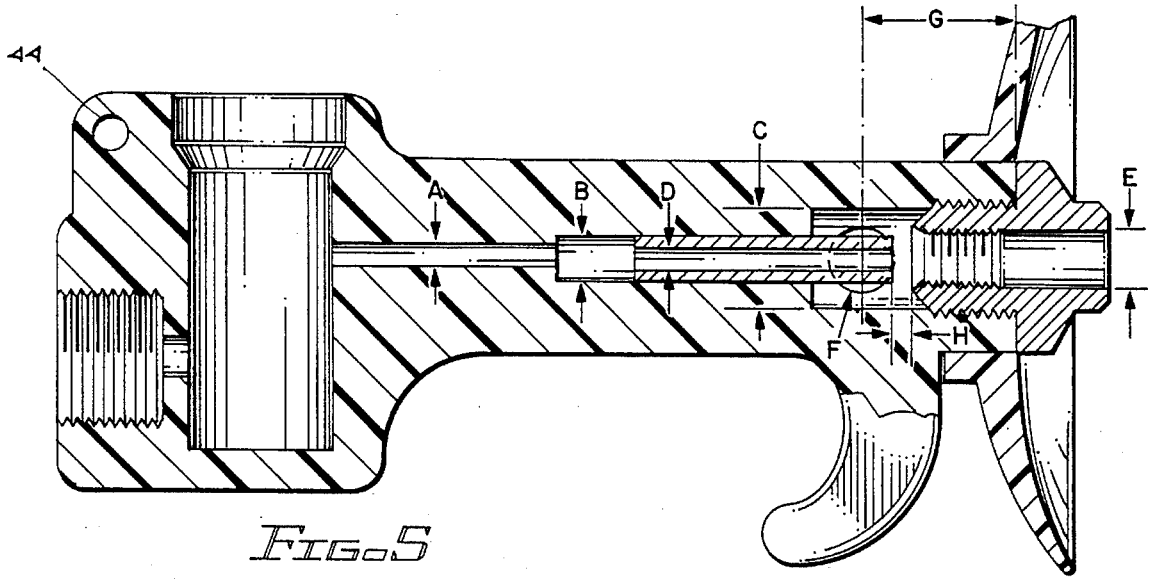
FIG. 5

SAFETY AIR GUN

BACKGROUND OF THE INVENTION

This invention relates to air gun which are used to deliver a stream of pressurized air to a work area. More particularly, this invention relates to safety air guns which have a dead end pressure of less than thirty pounds per square inch (psi).

Compressed air is widely used in industry to power pneumatic tools such as air hammers, nail guns, and pneumatic wrenches. The line pressure needed to operate such tools is typically between 85 and 125 psi. Workers have found that compressed air from such lines can be effective for dusting and for the removal of debris from a work area. Accordingly, air guns are routinely interchanged with pneumatic tools when the work area needs cleaning.

Pressurized air can be very dangerous in the work place. In the past, either by accident or as a result of a practical Joke, workmen have been subjected to the high pressure air stream. If this air stream comes in close contact with exposed skin, it may penetrate the epidermis and enter the blood stream. Air bubbles may then proceed to the brain causing immediate death.

In response to concerns over worker safety, the Occupational Safety and Health Administration (OSHA) has promulgated Rule 1910.242(b). The Rule states that compressed air used for cleaning must not exceed thirty psi. This is a measurement of "dead end" pressure with no air escaping from the gun's outlet nozzle. Additionally, the Rule states that air pressure cleaning can only be used with effective chip guarding and personal protection equipment.

Various air gun designs have attempted to solve this problem. Frequently, escape holes are provided in the side of an air outlet tube to release air if the outlet opening is blocked. In some guns air is drawn into the outlet tube through the side openings when the outlet opening is not blocked. While these designs have adequately reduced the dead end (blocked outlet) output pressure to a safe level, they are easily modified by a worker to produce a more powerful tool. A worker can simply wrap tape around the escape holes to block air passage therethrough. The result is a tool with a more powerful air stream. However, the tool is now more dangerous since the dead end pressure is now equal to the line pressure of 85 to 125 psi.

It is an object of the present invention to provide a safety air gun which effectively reduces line pressure of 85 to 125 psi to a safe level below thirty psi, while providing a tamper resistant design that severely reduces the incentive for worker modification. Another object of the invention is to provide a tamper resistant safety air gun that conserves pressurizing air by drawing ambient air into the air stream through the gun.

SUMMARY OF THE INVENTION

The present invention is an air gun having an interior channel with a predetermined diameter for delivering a stream of pressurized air. Pressurized air is delivered through a handle assembly having a manual gripping surface for an operator. The air gun has an air inlet connected to a pressurized air source for delivering pressurized air to the interior channel of the air gun. An air outlet provided with an outlet nozzle orifice allows egress of the pressurized air from the interior channel. An air valve is positioned within the handle assembly along the interior channel for controlling the release of pressurized air through the gun. An expansion chamber having a cross sectional area greater than that of said interior channel and the outlet nozzle orifice is positioned between the air valve and the air outlet nozzle. The expansion chamber has a side hole extending to the ambient air which is external to the air gun. The side hole is positioned in the expansion chamber such that air is drawn into the side hole during normal operation, providing supplemental additional ambient air for cleaning purposes, while air is released from the side hole, limiting dead end pressure to approved limits, if the air outlet means becomes blocked. The use of ambient air in addition to pressurized air markedly increases the useful air available to the gun while reducing the amount of pressurized air utilized. This results in a substantial cost saving.

An important feature of the present invention is that the expansion chamber and inlets and outlets thereof are formed such that the dynamic force of the output air is restricted more if the side hole becomes blocked than if the side hole is open. Thus, a worker would have no incentive to modify the air nozzle to an unsafe condition.

BRIEF DESCRIPTION OF THE DRAWINGS

FIG. 1 is a side sectional view of the present invention showing the internal air channel passage.

FIG. 2 is a side view of the present invention showing an optional extension.

FIG. 3 is a top view of the present invention with the chip protector and lever arm removed.

FIG. 5 is a side sectional view showing$_G$ dimension references of the preferred embodiment.

DETAILED DESCRIPTION OF THE PREFERRED EMBODIMENT

Figure 4:
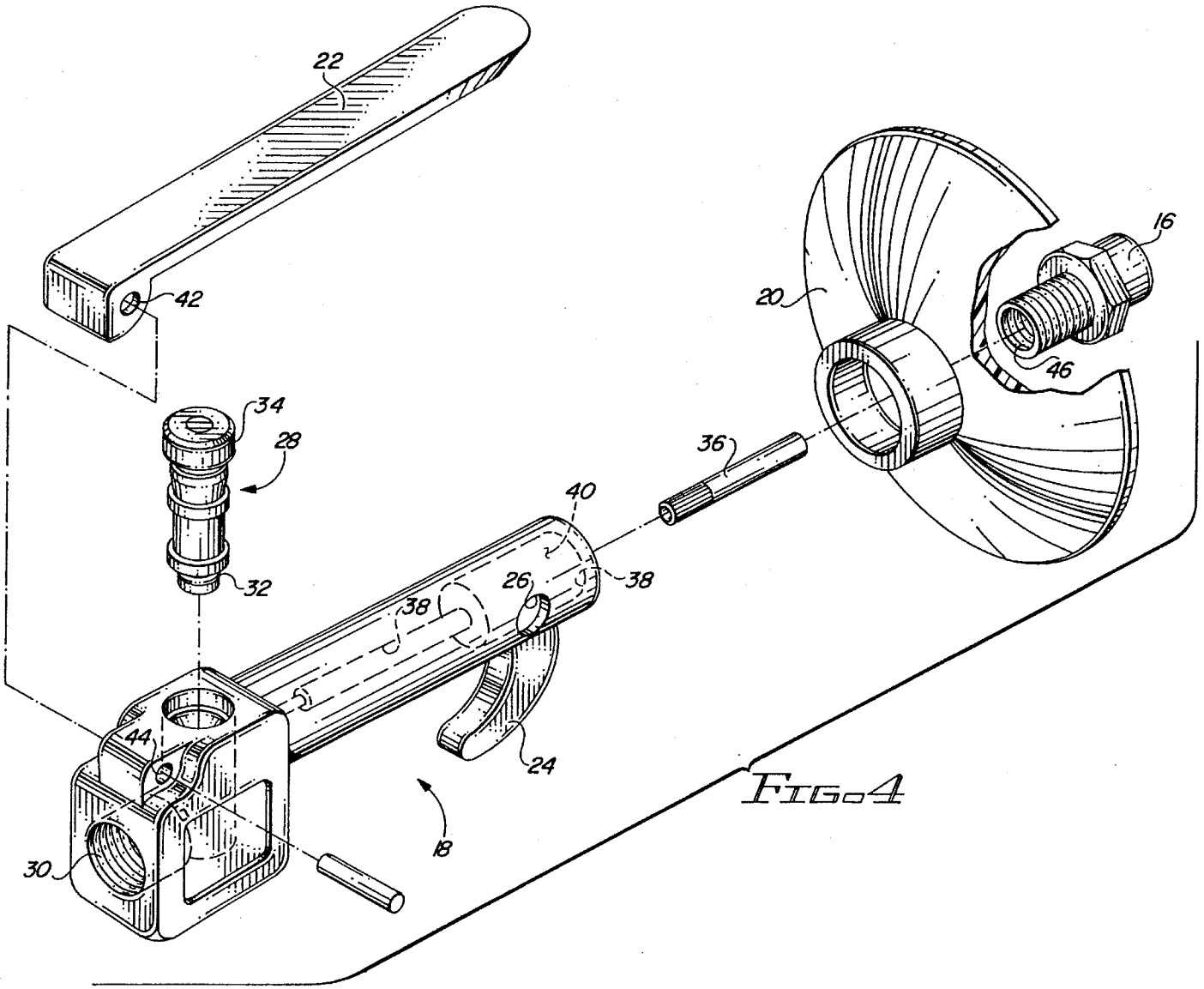
FIG. 4. a exploded perspective view of the present invention.

Referring to the drawings and more particularly to FIG. 2, a side view of air gun 10 is shown with a nozzle extension 12 separated from air gun 10 for clarity. In practice, nozzle extension 12 having threaded end 14 is received within an outlet end of air gun 10 along the inside of outlet nozzle fitting 16. Nozzle extension 12 is configured so that it may be removed by a worker to provide a broader dusting operation. Nozzle extension 12 may be optionally attached to air Gun 10 by the worker to afford better dusting between small pieces of machinery. Nozzle extension 12 is simply a piece of copper tubing in optional lengths such as three or five inches. The volume of air emitted, and thereby the effectiveness of the tool, decreases as extension length increases.

Air gun 10 has a main body 18 that serves as a handle, with a chip guard 20 and lever arm 22 attached. Chip guard 20 is required under OSHA Rule 1910.242(b) and provides chip protection to the worker from flying debris. Lever arm 22 allows the worker to activate air Gun 10 by simply pressing lever arm 22 downwardly to actuate a valve 28.

Air gun 10 also includes hook 24 which is molded integrally with main body 18. Main body 18 including hook 24 is molded from an impact resistant synthetic resin such as nylon. Hook 24 provides a forward stop for engaging the fingers of a hand when holding the Gun and also provides a means for hanging air gun 10 when not in use. Additionally, hook 24 seeks to deter a worker from closing side hole 26 with tape. Should a worker attempt to wrap tape about main body 18 in an effort to plug side holes 26, hook 24 will impede him in his attempt. Due to the irregular shape of hook 24, tape will not easily adhere across side hole 26.

In reference to FIGS. 3 and 4, air gun 10 is shown from different view points to facilitate a better understanding thereof. Air gun 10 has valve 28 positioned along interior channel 38. The air path follows air inlet 30, through valve 28, into flow tube 36, then out of nozzle fitting 16.

In the exploded perspective view of FIG. 4, valve 28 is shown positioned beneath lever arm 22. When main body 18 is connected to a pressurized air source via air inlet 30, the resulting air pressure pushes piston 32 upwardly with respect to valve 28 to effectively shut off the flow of air. As piston 32 is raised upwardly, button 34 of valve 28 is also pushed upwardly to raise lever arm 22. Thus, to activate air gun 10, lever arm 22 is simply depressed, thereby depressing button 34. This then allows continuous air flow throughout main body 18.

Flow tube 36 is positioned within interior channel 38 and is placed with its outer end in front of but nearly adjacent to side holes 26. The outer end of the flow tube should be in front of the side holes. Flow tube 36 protrudes into an expansion chamber 40 and terminates at an outer end that is spaced a predetermined distance from an inner end of nozzle fitting 16. In the preferred embodiment flow tube 36 is a cylindrical metal tube that has been forced into interior channel 38 of main body 18. However, flow tube 36 could be part of the continuous nylon mold of main body 18.

Lever arm 22 is an optional accessory, unlike chip guard 20 which must be used in accordance with main body 18 to provide full compliance with OSHA Rule 1910.242(b). Lever arm 22 is shown rotatable about lever axle 42. Lever axle 42 passes through lever arm 22 and lever hole 44 of main body 18.

In reference to FIG. 1, a more detailed sectional view of air gun 10 is shown. Interior channel 38 is shown beginning with air inlet 30 and continuing to expansion chamber 40. Air then escapes through the outlet orifice formed by inner passage 46 of nozzle fitting 16. Interior channel 38 is actually a combination of interior sections which provide a variety of functions. Air inlet 30 is provided with a threaded perimeter to connect with a standard pressurized air line. Air inlet 30 connects to valve chamber 48. Valve chamber 48 is shaped to firmly secure valve 28 in its closed position after it has been placed therein.

Valve chamber 48 connects to three distinct passages of interior channel 38. Primary passage 50 serves as a connecting passage between valve chamber 48 and secondary passage 52. Secondary passage 52 firmly secures flow tube 36 in place. Flow tube 36 does not contact primary passage 50 for ease of manufacture. Since proper placement of flow tube 36 is important to the invention, flow tube 36 may be adjusted to the proper position during manufacture without limitation.

Secondary passage 52 connects to the exterior of air gun 10 by tertiary passage 54. Tertiary passage 54 extends to the exterior of main body 18 and is spacially limited only by flow tube 36 and nozzle fitting 16. Expansion chamber 40 is thus formed from tertiary passage 54 and is restricted at the outlet thereof by the nozzle fitting 16 and its restricted orifice opening 46. Side holes 26 are formed into tertiary passage 54.

The placement of the end of flow tube 36 in close proximity to nozzle fitting 16 combined with the placement of side holes 26 in the expansion chamber creates a venturi effect, which produces a pressure drop in the expansion chamber. This causes ambient air to be drawn in through side holes 26 into expansion chamber 40 and then out through inner passage 46. The pressurized air at air inlet 30 which can be 85 to 100 psi is thus combined with ambient air via side holes 26 to provide a more powerful output of air through inner passage 46. The volume of air output through inner passage 46 is satisfactory to perform a variety of tasks such as dusting a work area. The use of ambient air means that less pressurized air is required for air gun operation.

If during the operation of air gun 10 the outlet of the nozzle becomes blocked so as to prevent airflow through inner passage 46, pressurized air from flow tube 36 escapes through side holes 26. The air holes are such that dead end or closed outlet pressure at inner passage 46 is below 30 psi even when the line pressure is 85–100 psi.

It is almost traditional for workers to attempt to create a more powerful pneumatic force through nozzle 16 by blocking side holes 26. With prior nozzles this would create a dangerous condition since the dead end pressure at inner passage 46 would then equal the line pressure of 80 to 100 psi. However, with the present invention, the air output through inner passage 46 actually decreases considerably when the air holes are blocked. The air nozzle then becomes a less effective tool. This causes the worker to unblock side holes 26. Air gun 10 with side holes 26 blocked works in a more inefficient manner to discourage tampering of this type.

While the mechanism by which the present invention causes an air flow drop when the holes are blocked is not known conclusively, it is believed that the phenomenon is caused at least in part by turbulence that is induced in the expansion chamber when the side holes are blocked, which in turn disrupts the laminar air flow across the gap between the opposed ends of tube 36 and nozzle 16.

In the preferred practice of the present invention, the interior channel and expansion chamber are cylindrical chambers, with the ends of the expansion chamber being perpendicular to the axis. The nozzle fitting 16 that screws into the outer or outlet end of the expansion chamber is also cylindrical but has an inner end with a beveled outer surface that is inclined outwardly from the axis of the nozzle orifice in the direction toward the nozzle outlet. Thus, to the extent that air traveling in the expansion chamber across the gap between the opposed ends of tube 36 and nozzle 16 expands radially outwardly beyond the diameter of the nozzle orifice, the air engages the end of the nozzle and is diverted away from the nozzle orifice into the expansion chamber. This causes the air to swirl in the expansion chamber in a turbulent fashion. This turbulence can further disrupt the air flow across the gap by providing a lateral disruption to the laminar air flow across the gap. The diversion of air away from the outlet orifice and the introduction of turbulence in the air flow causes a substantial pressure drop across the gap and a dramatic drop in the dynamic air force at the outlet.

A significant feature of the shape of the expansion chamber outlet is believed to be the fact that the surface area around the periphery of the outlet orifice is not contoured to direct the radially expanding air in the air gap back into the outlet. Instead the surface is contoured to direct that air away from the outlet and cause the air to swirl in the expansion chamber and disrupt the air flow across the gap. A nozzle fitting with a flat end oriented perpendicular to the axis of the orifice also diverts air flow impinging on that surface away from the orifice, thus also serving to induce turbulence in the expansion chamber.

In practice, it has been observed that the drop in dynamic air force caused by blocked side holes varies with the particular dimensional limitations as set forth in the following tables. Reference should be made additionally to FIG. 5 which shows the preferred practice of the present invention with regard to dimension.

In reference to Table 1, "A" designates the diameter of primary passage 50. "B" designates the diameter of secondary passage 52. "C" designates the diameter of the expansion chamber or tertiary passage 54. "D" designates the diameter of the interior section of flow tube 36 (the inlet is the expansion chamber). "E" is the diameter of inner passage 46 of nozzle fitting 16 (the outlet to the expansion chamber). "F" is the diameter of side hole 26. "G" is the distance between the center of side hole 26 and the front end of main body 18. "H" is the distance between the outer end of flow tube 36 and the inner end of nozzle fitting 16.

TABLE 1

Dimensions for Preferred Embodiment

| Designation | Length in Inches |
|---|---|
| A | .116 |
| B | 3/16 |
| C | .327 |
| D | .104–.118 |
| E | .21875 |
| F | .250 |
| G | Varies (see Table 2) |
| H | Varies (see Table 2) |

The inventor has discovered that the exact placement of side holes 26 is not critical to practice the present invention, as long as the holes are not placed in front of the end of tube 36. The holes should be positioned such that the desired venturi action is achieved when the holes are unblocked. Desirably the holes are placed just behind (upstream from) the end of tube 36. The depth of insertion for flow tube 36 into interior channel 38, or more precisely, the distance between the end of flow tube 36 and the interior end of nozzle fitting 16 appears to be most critical, as reflected in Table 2.

TABLE 2

EXPERIMENTAL DATA

| | H in Inches | G = 1.075 Dead End psi | G = 1.205 Dead End psi |
|---|---|---|---|
| 1. | .0645 | 30 | 30 |
| 2. | .0845 | 28 | 25 |
| 3. | .1045 | 26 | 23 |
| 4. | .1245 | 25 | 19 |
| 5. | .1445 | 22 | 19 |
| 6. | .1645 | 18 | 20 |
| 7. | .1845 | 19 | 28 |
| 8. | .2045 | 24 | 32 |
| 9. | .2245 | 28 | 30 |
| 10. | .2445 | 30 | 29 |
| 11. | .2645 | 28 | 28 |
| 12. | .2845 | 26 | 28 |
| 13. | .3045 | 24 | 26 |
| 14. | .3245 | 20 | 24 |
| 15. | .3445 | 19 | 22 |
| 16. | .3645 | 18 | 20 |
| 17. | .3845 | 17 | 19 |

For minimum dead end pressure, the preferred practice is to set G=1.075 inches and H=0.1645 inches.

Several interesting phenomenon are disclosed through the test results shown in Table 2. It should be noted, however, that all relevant measurements for dead end pressure must be below thirty psi to comply with the OSHA Rules. Dead end pressure for both values of G fluctuates between 32 psi and 17 psi in an identifiable pattern as H is varied. Measurements for G appear to follow two inverted bell shaped curves placed side by side. Since the observed data follow the same general pattern regardless of the distance G, it appears that this is not the most critical factor.

Instead, it appears that the measurement H is an important factor for achieving the desired results. While any value of H yielding dead end pressure less than 30 is acceptable under OSHA, a lower value of psi is preferred. With the dimensions optimized for a lower psi value, greater tolerances are allowed while still meeting the OSHA requirements.

While it is contemplated that the preferred values of H may vary with structural modifications of the gun, in the preferred gun H should be greater than 0.0645 inches and preferably should be between 0.0645 and 0.2445 inches. A preferable range of values is H=0.1245 to 0.2045 inches for G=1.075 inches and H=0.0845 to 0.1845 inches for G=1,205 inches. The most preferred values are H=0.1645 inches for G=1.075 inches and H=0.1245 inches to 0.1445 inches for G=1,205 inches. Note that the second inverted bell curve for each value of G, namely H<0.2445 inches for G=1,075 inches and H<0.1845 inches for G=1.205 inches, is acceptable for OSHA dead end pressure purposes but are not the preferred range of acceptable values. For these values, air blows outwardly from side holes 26 when nozzle extension 12 is placed thereon, thus defeating the efficiency achieved by using the "free" air drawn into the outlet stream by the venturi effect.

In addition to decreasing "dead end" static air pressure at each of the respective values of G and H in the foregoing test (i.e. by blocking the outlet with a pressure gauge), a measurement referred to as "air force" was also made with the nozzle outlet open by measuring the force of the rushing air against a scale. This measurement disclosed a surprising drop in air force when the vent holes are closed. These results are shown in Table 3.

TABLE 3

AIR FORCE MEASUREMENTS
Air Force in Ounces (G = 1.075, 1.205)

| H in Inches | Vent Open | Vent Closed |
|---|---|---|
| .0645–.2445 | 11 | 5 ½ |
| .2645–.3845 | 10 | 5 ½ |

Thus, while the values of H and G do not appear to be critical for purposes of dynamic outlet air force (at least in the range where dead end pressure is less than 30 psi), if an operator tries to defeat the dead end pressure safety feature by blocking the vent holes, he will find that his efforts are counterproductive and that the outlet air force is cut in half. Thus, the safety valve feature of the present invention is effectively undefeatable. This is a marked improvement over prior art devices, wherein the safety feature is defeated by blocking the vent holes.

Another feature of the invention disclosed is that it permits the manufacturer of air guns having the desired safety feature of lowering air force when the holes are blocked by a simple modification of the existing gun that provides neither the ambient air inlet or the safety feature. A gun as shown without tube 36 is currently in production. Modifying the product by the addition and insertion of tube 36 provides both the venturi effect and the safety features when the side holes are blocked.

Although the preferred practice of the present invention has been described above, it will be apparent to those skilled in the art that certain variations or modifications of the invention may be made with effective results but without parting from the scope of the invention which is defined in the following claims.

I claim:

1. A safety air gun comprising a handle with an interior air channel therethrough leading from an inlet for pressurized air to an outlet for discharging pressurized air, the interior channel having an expansion chamber therein, the expansion chamber having an aligned expansion chamber inlet and outlet, the expansion chamber inlet is formed by an inlet tube of predetermined length that protrudes into the expansion chamber from an inlet end thereof, the expansion chamber also having at least one vent hole therein that is vented to atmosphere, the expansion chamber having a larger cross-sectional area than the expansion chamber inlet and outlet, the air gun and expansion chamber being formed such that the dynamic force of air discharged from the air gun outlet is lower when the vent hole is blocked than when the vent hole is open.

2. A safety air gun according to claim 1 wherein the expansion chamber comprises an interior surface surrounding the expansion chamber outlet that is shaped such that when a portion of the air flowing from the expansion chamber inlet toward the expansion chamber outlet impinges on said surface, the air is urged away from the outlet into the expansion chamber.

3. A safety air gun according to claim 2 wherein the surface surrounding the expansion chamber outlet is inclined radially outwardly and axially downwardly as it extends in the direction of air flow, such that air flowing across the gap that engages the surface surrounding the expansion chamber outlet engages the inclined surface and is deflected away from the outlet and sets up a turbulent air flow pattern in the expansion chamber.

4. A safety air gun according to claim 2 wherein the expansion chamber outlet comprises an enlarged opening in which a nozzle fitting is mounted, the nozzle fitting having an orifice therethrough that serves as the air outlet from the expansion chamber, the nozzle fitting having an inner end that comprises the surface surrounding the outlet to the expansion chamber.

5. A safety air gun according to claim 1 wherein the gap between the inlet and outlet of the expansion chamber has an axial length of at least 0.0645 inches.

6. A safety air gun according to claim 1 wherein the gap between the inlet and outlet of the expansion chamber has an axial length of about 0.0645 to 0.2245 inches.

7. A safety air gun according to claim 1 wherein the gap between the inlet and outlet of the expansion chamber has an axial length of about 0.1245 to 0.2045 inches.

8. A safety air gun according to claim 1 wherein the gap between the inlet and outlet of the expansion chamber has an axial length of about 0.1645 inches.

9. A safety air gun according to claim 1 wherein the gun is formed of a synthetic resin, the gun including an outlet nozzle fitting mounted in an open end of the expansion chamber that is opposite to the inlet end, an outlet orifice in the nozzle fitting comprising the expansion chamber outlet wherein air is drawn into the expansion chamber through a side hole and discharged through the outlet with the pressurized air when the outlet nozzle is unblocked.

10. A safety air gun according to claim 9 wherein the spacing between the opposed ends of the inlet tube and nozzle fitting is optimized to reduce the dead end pressure at the nozzle outlet when the outlet is blocked.

11. A safety air gun according to claim 9 wherein the position of the vent hole is optimized to maximize the inward flow of ambient air through the vent hole when the outlet is unblocked and to minimize dynamic air force at the nozzle outlet when the vent hole is blocked.

12. A safety air gun wherein pressurized air is conveyed from an inlet to an outlet through an internal air passage through the gun, the gun having a vent opening in a side thereof upstream of the outlet, the vent opening leading from the internal air passage to ambient air on the outside of the gun, the air passage having an expansion chamber at the air gun outlet that has a larger cross-sectional area than the internal air passage upstream from the expansion chamber, the expansion chamber comprising an outlet with an outlet orifice having a smaller cross-sectional area than the expansion chamber, the gun comprising an inlet tube that fits in the air passage upstream of the expansion chamber and extends into the expansion chamber in alignment with the outlet orifice, the outlet tube and outlet orifice having opposed ends that are spaced apart by a distance such that the dynamic air force through the outlet orifice is less when the vent hole is blocked than when the vent hole is open.

13. A safety air gun according to claim 12 wherein the gap between the inlet and outlet of the expansion chamber has an axial length of about 0.0645 to 0.2245 inches.

14. A safety air gun according to claim 12 wherein the gap between the inlet and outlet of the expansion chamber has an axial length of about 0.1245 to 0.2045 inches.

15. A safety air gun according to claim 12 wherein the gap between the inlet and outlet of the expansion chamber has an axial length of about 0.1645 inches.

16. A safety air gun comprising a handle with an interior air channel therethrough leading from an inlet for pressurized air to an outlet for discharging pressurized air, the interior channel having an expansion chamber therein, the expansion chamber having an aligned expansion chamber inlet and outlet, the expansion chamber inlet and outlet being separated by a gap of about 0.0645 to 0.2245 inches in length, the expansion chamber also having at least one vent hole therein that is vented to atmosphere, the vent hole being positioned no further forwardly in the direction of air flow tan the expansion chamber inlet, the expansion chamber having a larger cross-sectional area than the expansion chamber inlet and outlet, the air gun and expansion chamber being formed such that there is a drop in the dynamic force of air discharged from the air gun outlet when the vent hole is blocked relative to the dynamic force of the air when the vent hole is open.

17. A safety air gun according to claim 16 wherein the expansion chamber comprises an interior surface surrounding the expansion chamber outlet that is shaped such that when a portion of the air flowing from the expansion chamber inlet toward the expansion chamber outlet impinges on said surface, the air is urged away from the outlet into the expansion chamber, the surface surrounding the expansion chamber outlet being inclined radially outwardly and downwardly in the direction of air flow, such that air flowing across the gap that engages the surface surrounding the expansion chamber outlet engages the inclined surface and is deflected away from the outlet and sets up a turbulent air flow pattern in the expansion chamber.

18. A safety air gun according to claim 16 wherein the gap between the inlet and outlet of the expansion chamber has an axial length of about 0.1245 to 0.2045 inches.

19. A safety air gun according to claim 18 wherein the gap between the inlet and outlet of the expansion chamber has an axial length of about 0.1645 inches.

20. A method of manufacturing an air nozzle having: an interior channel with a first section and a second section each of respective predetermined diameter; an expansion chamber of predetermined diameter greater than the interior channel positioned between the first section and the second section; and a side hole connecting the expansion chamber with ambient air, wherein said first section connects the interior channel to a source of pressurized air and said second section connects the expansion chamber to the ambient air said method comprising the step of:

positioning a tube with one end connected to the first section and one end positioned within the expansion chamber with sufficient proximity to the second section that: ambient air is drawn into the side hole to thereby increase the volume of air expelled from the air nozzle during normal operation; pressurized air is expelled from the side hole if the second section becomes plugged; and the dynamic force of the air expelled through the first section is decreased should the side hole become plugged.

21. The method of manufacturing an air nozzle according to claim 20 further comprising the step of locating the side hole in sufficient relation to the tube such that dead end pressure at the output of said second section is less than 30 psi.

* * * * *